US005533134A

United States Patent [19]

Tokura et al.

[11] Patent Number: 5,533,134

[45] Date of Patent: Jul. 2, 1996

[54] MOTIONAL FEEDBACK LOUDSPEAKER APPARATUS HAVING A COUPLING MEMBER FOR CONNECTING A VOICE COIL BOBBIN WITH A DETECTING COIL BOBBIN

[75] Inventors: Kunihiko Tokura, Saitama; Masaru Uryu; Kenji Yamada, both of Chiba, all of Japan

[73] Assignee: Sony Corporation, Tokyo, Japan

[21] Appl. No.: 287,294

[22] Filed: Aug. 8, 1994

[30] Foreign Application Priority Data

Aug. 16, 1993 [JP] Japan ..... 5-202418

[51] Int. Cl.[6] ..... H04R 3/00

[52] U.S. Cl. ..... 381/96; 381/195

[58] Field of Search ..... 381/96, 195, 197

[56] References Cited

U.S. PATENT DOCUMENTS

| | | | |
|---|---|---|---|
| 2,857,461 | 10/1958 | Brodie | 381/96 |
| 3,798,374 | 3/1974 | Meyers | 381/96 |
| 3,821,473 | 6/1974 | Mullins | 381/96 |
| 4,220,832 | 9/1980 | Nagel | 381/195 |
| 4,276,443 | 6/1981 | Meyers | 179/1 F |
| 4,550,430 | 10/1985 | Meyers | 381/96 |
| 5,327,504 | 7/1994 | Hobelsberger | 381/96 |

FOREIGN PATENT DOCUMENTS 57-43437 9/1982 Japan .

*Primary Examiner*—Stephen Brinich

*Attorney, Agent, or Firm*—Hill, Steadman & Simpson

[57] ABSTRACT

A loudspeaker apparatus includes a diaphragm, a driving part driving a diaphragm, a detecting part and a coupling member. The driving part includes a voice coil bobbin mounted on the diaphragm, a voice coil wound about the voice coil bobbin and a driving magnetic circuit generating a driving power driving the diaphragm along with the voice coil. The detecting part has its terminal voltage changed responsive to the rate of displacement of the diaphragm or the voice coil bobbin. The detecting part has a detection bobbin about which a detection coil is wound and a detection magnetic circuit for detecting displacement of the diaphragm or the voice coil bobbin along with the detection coil. The connecting member is cup-shaped and formed of a liquid crystal polymer material. The coupling member has its surface smoothly curved from the outer lateral side towards the center. The coupling member has one of the voice coil bobbin and the detection bobbin mounted on its outer peripheral surface and the other of the voice coil bobbin and the detection bobbin mounted on its mid portion. The driving part and the detection part are arranged coaxially. A detection signal of the detecting part is fed back to the driving part.

15 Claims, 12 Drawing Sheets

MOTIONAL FEEDBACK LOUDSPEAKER APPARATUS HAVING A COUPLING MEMBER FOR CONNECTING A VOICE COIL BOBBIN WITH A DETECTING COIL BOBBIN

BACKGROUND

1. Field of the Invention

This invention relates to a loudspeaker apparatus. More particularly, it relates to a loudspeaker apparatus employing a motional feedback technique.

2. Background of the Invention

In general, a loudspeaker apparatus employing a motional feedback (MFB), referred to hereinafter as MFB speaker, detects vibrations of a vibrating system and feeds the vibrations back to an amplification circuit to form a feedback loop for driving the vibrating system. It is thereby possible with the MFB speaker to reproduce audio signals with high sound quality.

With the MFB speaker, driving signals are supplied to a voice coil arranged in a gap of a first magnetic circuit for vibrating a diaphragm connected to the voice coil in accordance with driving signals.

Besides, with the MFB speaker, vibrations of the voice coil are transmitted to a detection coil arranged in a second magnetic circuit so that vibrations of the diaphragm and the voice coil are detected by the detection coil.

Thus the MFB speaker provides a feedback loop of feeding back an output signal of the detection coil to an amplification circuit.

It may now be contemplated that, with the MFB speaker, the overall size of the speaker may be .reduced if the voice coil and the detection coil are coaxially arranged by the application of a coaxial two-way speaker system as disclosed for example in JP Utility Model Kokai Publication No.57-43437.

However, if the voice coil and the detection coil are coaxially arranged by simply applying the coaxial two-way speaker system disclosed in the above-cited Publication, it may occur that the detection coil is vibrated in a wobbling manner in case of vibrations of the voice coil displaced linearly in the axial direction.

Thus it becomes difficult to detect the vibrations of the vibrating system by the detection coil so that high-quality audio signals cannot be reproduced.

It may now be contemplated to have the voice coil and the detection coil held coaxially with the use of a sturdy holding member for reducing wobbling of the detection coil.

However, if the holding member is of a sturdy structure, the vibrating system is increased in mass weight as a result of which the response characteristics of the loudspeaker apparatus is deteriorated.

FIG. 1 shows basic detected MFB signals. Since the detection signal of the MFB speaker is the measured value of the vibrating speed of the diaphragm, an output level is decreased from a maximum value in the vicinity of $f_0$. As the frequency characteristics of the detection signal, measurement is made of the resonant peak of a connecting portion between the voice coil and the detection coil.

Consequently, if the resonant level approaches an output level set for MFB, a detection signal deviated from a pre-set phase is applied to an output side, so that the problem of oscillation is raised.

Attempts have been made to eliminate such oscillation by a vibration damper, such as rubber damper, to a coupler for suppressing resonant peaks. However, the vibrating system is increased in mass weight thereby affecting speaker characteristics and increasing the number of process steps.

SUMMARY OF THE INVENTION

It is therefore an object of the present invention to provide a loudspeaker apparatus which resolves the above-mentioned problem.

A loudspeaker apparatus according to the present invention includes a diaphragm, a driving unit, a detecting unit and a connecting member. The driving unit drives the diaphragm, and has a first bobbin, a voice coil wound about the first bobbin, and a driving magnetic circuit for generating the driving power driving the diaphragm along with the voice coil. The detection unit has its terminal voltage changed responsive to the rate of displacement of the diaphragm or the first bobbin, and includes a second bobbin arranged coaxially as the first bobbin, a detection coil wound about the second bobbin and a detection magnetic circuit for detecting displacement of the diaphragm or the first bobbin along with the detection coil. A coupling member interconnects the first and second bobbins so that the first and second bobbins are aligned coaxially. The coupling member interconnects the first and second bobbins so that the end of the first bobbin is protruded beyond the end of the second bobbin in the coaxial direction, and has its outer surface smoothly curved towards the center from outside of the coaxial line.

Another loudspeaker apparatus according to the present invention comprises a diaphragm, a driving unit, a detecting unit and a connecting member. The driving unit drives the diaphragm responsive to an input driving signal. The driving unit has a first bobbin mounted on the diaphragm, a voice coil wound about the first bobbin and a driving magnetic circuit for producing a driving power driving the diaphragm along with the voice coil. The detection unit has its terminal voltage changed responsive to the rate of displacement of the diaphragm or the first bobbin. The detection unit has a second bobbin about which a detection coil is wound and a detection magnetic field detecting displacement of the diaphragm or the first bobbin along with the detection coil. A coupling member interconnecting the first and second bobbins is cup-shaped and has its front surface smoothly curved from the outer side towards the center. The coupling member has one of the first and second bobbins mounted on its outer periphery and has the other of the first and second bobbins mounted at its mid portion. The driving unit and the detection unit are coaxially arranged and a detection signal of the detection unit is fed back to the driving means.

Still another loudspeaker apparatus according to the present invention comprises a diaphragm, a driving unit, a detecting unit and a connecting member. The driving unit drives the diaphragm responsive to the input driving signal. The driving unit includes a first bobbin mounted on the diaphragm and a voice coil wound about the first bobbin and generating a driving power driving the diaphragm along with the driving magnetic circuit responsive to the input driving signal. The detecting unit detects displacement of the first bobbin or the diaphragm. The coupling member interconnects the driving unit and the detecting unit. At least the coupling member is formed of a liquid crystal polymer.

According to the present invention, the coupling member has the outer surface smoothly curved in a recessed shape from the outer side towards the center in order to avoid disturbances of frequency characteristics effectively. As a result, a loudspeaker apparatus having a high sound quality may be realized.

Also, according to the present invention, since the coupling member is formed of a liquid crystal polymer material, it becomes possible to suppress high peaks of the resonance frequency by vibration damping characteristics and high toughness proper to the coupling member. As a result, the resonant level may be lowered to prevent the phenomenon of oscillation liable to be produced in the MFB loudspeaker apparatus.

BRIEF DESCRIPTION OF THE DRAWINGS

The present invention will be more readily understood with reference to the accompanying drawings, wherein.

DESCRIPTION OF THE INVENTION

Figure 1:
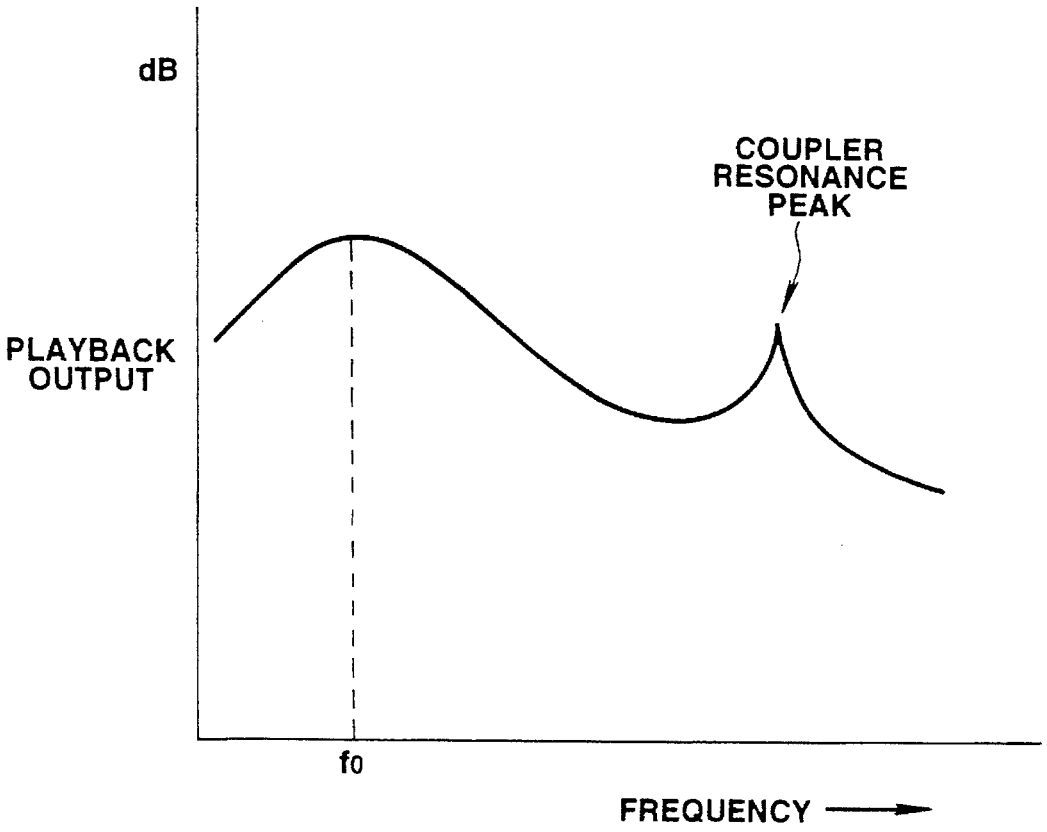
FIG. 1 is a graph showing a curve for a basic MFB signal detected with the MFB speaker.

Referring to the drawings, the loudspeaker apparatus according to the present invention will be explained in detail.

The loudspeaker apparatus according to a first embodiment of the present invention will be explained, in which the speaker is the above-mentioned MFB speaker.

Figure 2:
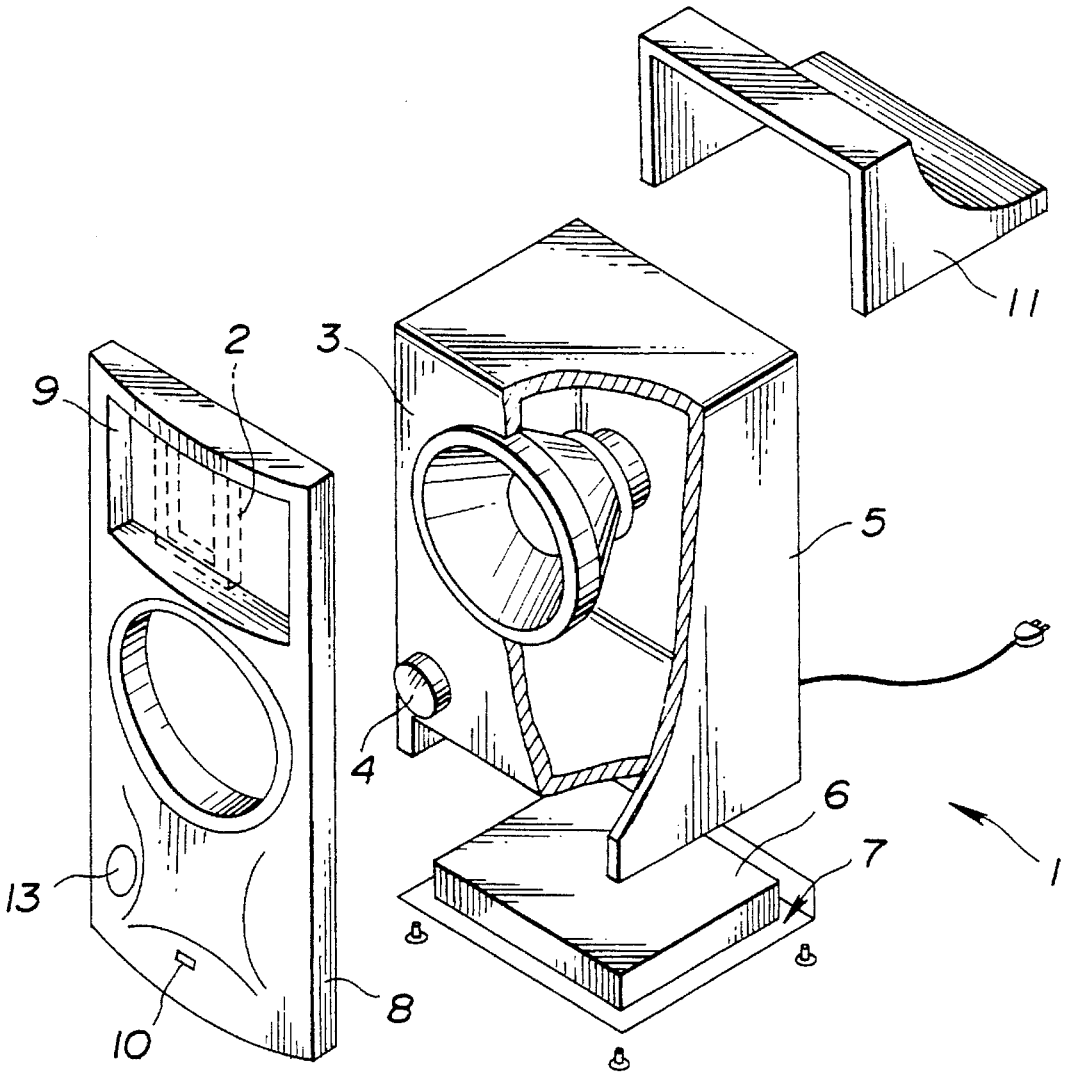
FIG. 2 is an exploded perspective view showing a construction of a loudspeaker according to a first embodiment.

Referring to FIG. 2, a loudspeaker apparatus 1, employed in a stereophonic audio system, is shown in an exploded perspective view. The loudspeaker apparatus 1 is made up of a static type speaker 2 having an amplification circuit enclosed therein and a MFB type speaker 3.

With the loudspeaker apparatus 1, the MFB type speaker unit 3 is mounted on a speaker box 5 having a protruded cylindrically-shaped duct 4 for constituting a bass-reflex type speaker system.

The speaker box 5 has both side plates extended downward so that a housing space for accommodating an amplifier or the like therein is defined below the speaker box 5 within the loudspeaker apparatus.

With the loudspeaker apparatus 1, a speaker driving circuit, such as a frequency divider, an amplifier or a power source circuit, is loaded on a chassis 6 within the housing space for constituting a driving unit 7 which is mounted on the speaker box 5.

Thus the loudspeaker apparatus 1 houses the driving circuit for the MFB speaker unit 3 therein for simplifying the interconnection between the loudspeaker apparatus and the audio reproducing device.

With the loudspeaker apparatus, the driving circuit is mounted on the speaker box 5, after which a front panel 8 is mounted on the front side of the speaker box 5.

The front panel 8 is designed so that its upper end is protruded above the upper surface of the speaker box 5, and a window 9 is formed in the upwardly protruded portion. The inner side of the window 9 is stopped with a punched metal sheet.

The static type speaker 2 is housed on the inner side of the window 9. The static speaker 2 is secured to the front panel 8 using set screws, not shown.

The static speaker is simplified in construction and reduced in size and thickness as compared to the conventional dynamic speaker.

By mounting the static speaker 2 on the front panel 8 using set screws, the speaker box 5 may be prevented from being increased in size. This reduces the size and the weight of the loudspeaker apparatus in its entirety.

With the present loudspeaker apparatus, the MFB speaker unit 3 and the static speaker unit 2 constitute a woofer unit and a tweeter unit, respectively. The driving circuit necessary for driving the static speaker unit 2 and the driving circuit necessary for driving the MFB speaker unit 3 are unified to constitute the driving unit 7. This also simplifies the interconnection between the static speaker unit 2 and the audio reproducing apparatus.

The front panel 8 has a through-hole 13 therein engaged by the duct 4 protruded from the speaker box 5 for exposing the duct 4 towards the front side.

The front panel 8 has an LED 10 on the mid lower region thereof which is lighted when the power supply to the loudspeaker apparatus is initiated conjunctively with the operation of the audio reproducing apparatus.

After the static speaker 2 and so forth are mounted on the front panel 8 of the loudspeaker apparatus 1, the front panel 8 is screwed to the speaker box 5 and subsequently the upper surface of the speaker box and the back side of the static speaker 2 are covered with a rear cover 11. Thus the loudspeaker apparatus 1 may be assembled by a simplified operation.

The rear cover 11 has a window on its rear surface which is stopped with a punched metal sheet, not shown, Thus it becomes possible for the loudspeaker apparatus to reproduce the high-pitched sound efficiently with high sound quality.

Figure 3:
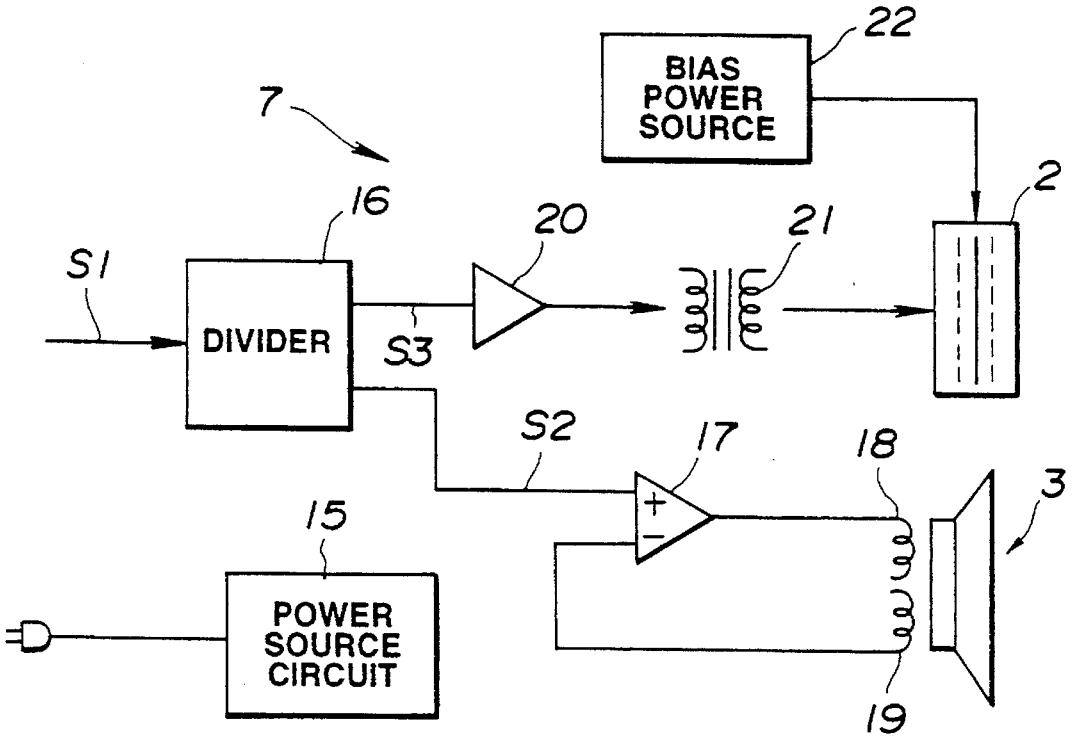
FIG. 3 is a block diagram of the loudspeaker shown in FIG. 2.

Referring to FIG. 3, the loudspeaker apparatus 1 drives the static speaker 2 and the MFB speaker 3 by means of the driving unit 7.

The driving unit 7 is fed with the commercial power and an audio signal S1 via a connector, not shown, formed on the back surface of the loudspeaker apparatus 1. The commercial power is supplied to a power source circuit 15 to generate a pre-set power which is fed to an amplification circuit and to a bias power source as later explained.

The driving unit 7 supplies the audio signal S1 to a frequency divider 16 whereby the audio signal is divided into a high-frequency component S3 and a low-frequency audio component S2 which is outputted to an amplification circuit 17.

The amplification circuit 17 drives a voice coil 18 of the MFB speaker unit 3 with the low-frequency audio signal S2 for reproducing the low frequency range audio signal. The MFB speaker unit 3 detects the vibrations of a voice coil 18 by a detection coil 19, and the results of detection of the vibrations are fed back to the amplification circuit 17. Thus the loudspeaker apparatus on the whole provides a feedback loop capable of reproducing low frequency range audio signals S2 with high sound quality.

The driving unit 7 amplifies the high range audio signal S3 by an amplification circuit 20 and outputs the amplified signal to a booster transformer 21, the secondary side output of which drives the static speaker 2.

The driving unit 7 generates the bias power for the static speaker 22 by a bias power source 22. The bias power is used for driving the static speaker 2.

The static speaker 2 and the MFB speaker 3 may be driven simply by coupling the audio signal and the commercial power source to the driving unit 7 contained integrally in the loudspeaker apparatus 1, thereby correspondingly simplifying the connecting operation of the loudspeaker apparatus 1 to the main audio apparatus.

Figure 4:
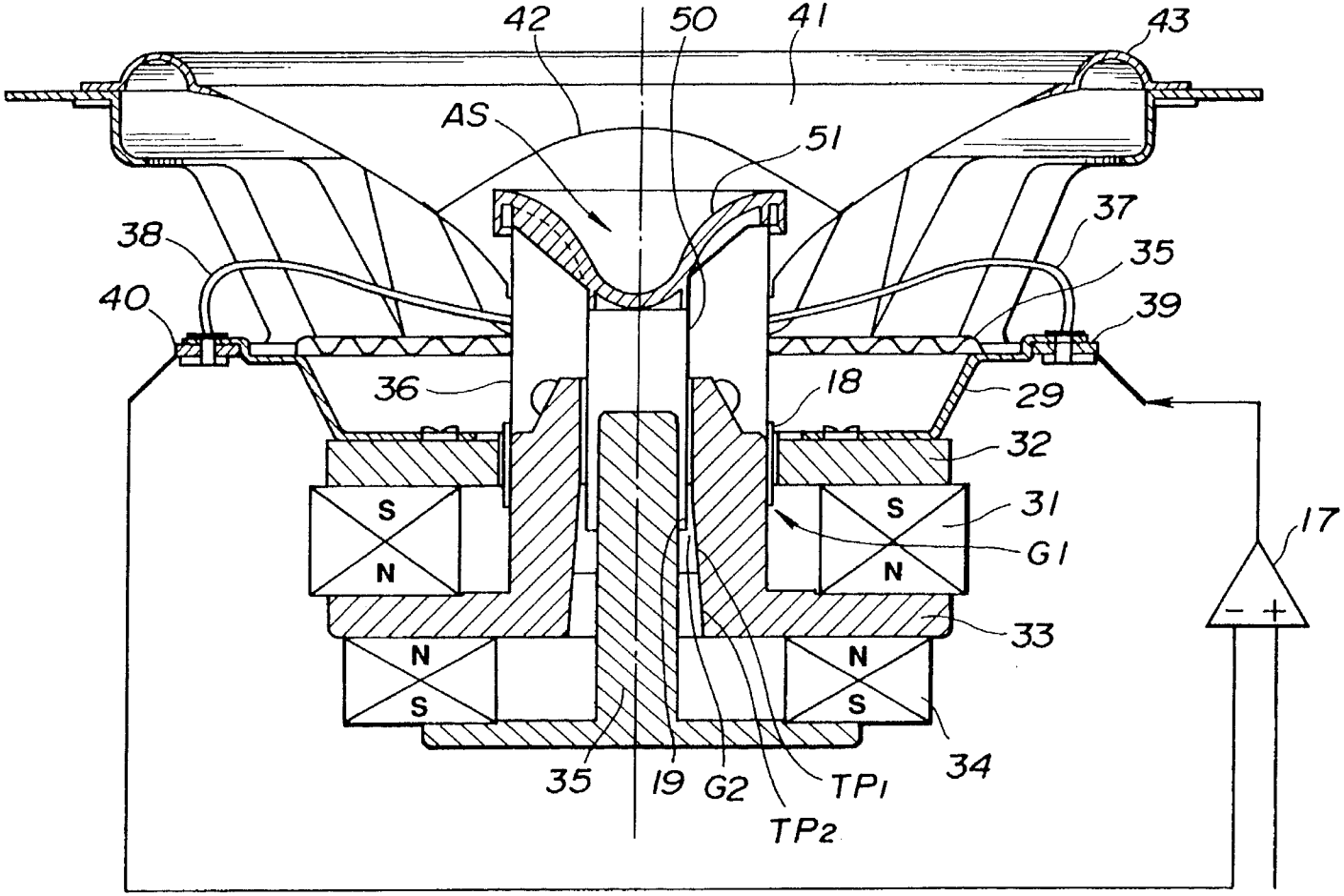
FIG. 4 is a cross-sectional view showing a MFB speaker unit.

With the MFB speaker unit 3, the magnetic circuit for driving the voice coil is completed by clamping both ends of a cylindrically-shaped magnet 31, having terminal N and S poles, by yokes 32 and 33, as shown in FIG. 4.

The yoke 32 comprises a plate member of a pre-set thickness which is worked into a ring. The yoke 32 has an inner lateral surface defining an end face of a magnetic gap G1 and an upper end face carrying a frame 29.

The yoke 33 is also worked into a ring for clamping the magnet 31 between it and the yoke 32. The yoke 33 has its inner upper cylindrical surface for defining a pole piece.

The pole piece of the yoke 33, has a cylindrical upstanding lateral surface defining an opposite end face of the gap G1. Thus a dc magnetic field traversing the gap G1 may be efficiently defined by the yokes 32 and 33. It is thus possible with the speaker unit 3 to drive the voice coil 18 maintained in the gap G1 efficiently.

The yokes 32 and 33 are formed with high machining accuracy, so that the magnetic gap G1 may be uniformly defined by a simple assembling operation of setting the magnet 31 by a pre-set jig and clamping the magnet 31 between the yokes 32 and 33, thereby facilitating the assembling operation for the speaker unit 3.

The inner lateral surface of the pole piece of the yoke 33 defines an end face of a magnetic gap G2 for the detection coil.

The yoke 33 holds a small-sized magnet 34 of the same shape as the magnet 31 along with a yoke 35 for defining a magnetic circuit for the detection coil. To this end, the yoke 35 is disc-shaped and has an upstanding central portion defining a pole piece.

The yoke 35 defines the gap G2 for the detection coil along with the yoke 33.

The yoke 35 is formed with high machining accuracy, so that the magnetic gap G2 may be uniformly defined by a simple assembling operation of setting the magnet 34 by a pre-set jig and clamping the magnet 34 between the yokes 35 and 33. On the other hand, by means of the yoke 35, the gap G2 may be defined with high accuracy coaxially with the magnetic gap G1.

That is, by coaxially arranging the voice coil 18 and the detection coil 19, the speaker unit may be reduced in size as a whole.

However, if the two coils are arranged coaxially in this manner, the assembling operation of arranging the vice coil 18 and the detection coil 19 in the magnetic gaps G1 and G2, respectively, becomes complex.

Consequently, with the present first embodiment, the voice coil 18 and the detection coil 19 are arranged coaxially to form a coil assembly AS, which is then arranged in the gaps G1 and G2 for simplifying the assembling operation.

However, during the assembling operation, it is necessary to have the voice coil 18 and the detection coil 19 assembled highly accurately on the same axial line, while it is similarly necessary to have the gaps G1 and G2 arranged coaxially on the same axial line, similarly with high accuracy.

Thus, with the speaker unit 3, the magnetic circuit can be assembled highly accurately by a simplified assembling operation, thereby simplifying the assembling operation in its entirety and diminishing fluctuations in the sound quality.

In constituting the magnetic circuit in this manner, the upstanding portion of the yoke 33 is formed so that the outer lateral end face of the gap G2 is extended upwardly. Besides, the upstanding inner sides of the yoke 33 are formed as tapered surfaces $TP_1$, $TP_2$ in order for the ,outer end face of the gap G2 not to be extended towards the magnet 34. This diminishes magnetic coupling between the magnetic circuit for the voice coil and the magnetic circuit for the detection coil.

After the magnetic circuits are formed in this manner, the frame 29 is connected to the yoke 32 and the coil assembly AS is introduced into the magnetic circuits.

The voice coil 18 is positioned correctly with respect to the magnetic gap G1, using a pre-set jig, after which the damper 35 is bonded to a voice coil bobbin 36 and the frame 29 for maintaining the voice coil 18 and the detection coil 19 with high accuracy.

In this manner, the speaker unit 3 may be assembled in a simple manner and with improved assembling accuracy.

After mounting the coil assembly AS in this manner, lead wires 37, 38 of the voice coil 18 and the detection coil 19 are connected to terminal plates 39 and 40 mounted on the frame 29. Lead wires, not shown, fed with output signals from the amplification circuit 17, are connected to the terminal plates 39, 40, for supplying driving signals to the speaker unit 3.

After completion of the connection of the terminal plates 39, 40, the voice coil bobbin 36 is connected to a diaphragm 41, after which a center cap 42 is bonded to a mid portion of the diaphragm 41.

In this manner, the speaker unit 3 may be assembled by a simplified assembling operation on the whole.

The diaphragm 41 is mounted on the frame 29 by bonding an thickened inner half portion 43 of the conical diaphragm 41 on the upper end of the frame 29. This improves frequency characteristics of the vibrating system for enabling reproduction of the high sound quality audio signals.

It is also possible with the speaker unit 3 to improve the sound quality of the reproduced sound by mounting the center cap 42 at a mid portion of the diaphragm 41. The center cap 42 is produced by suitably machining a transparent film sheet.

Figure 5:
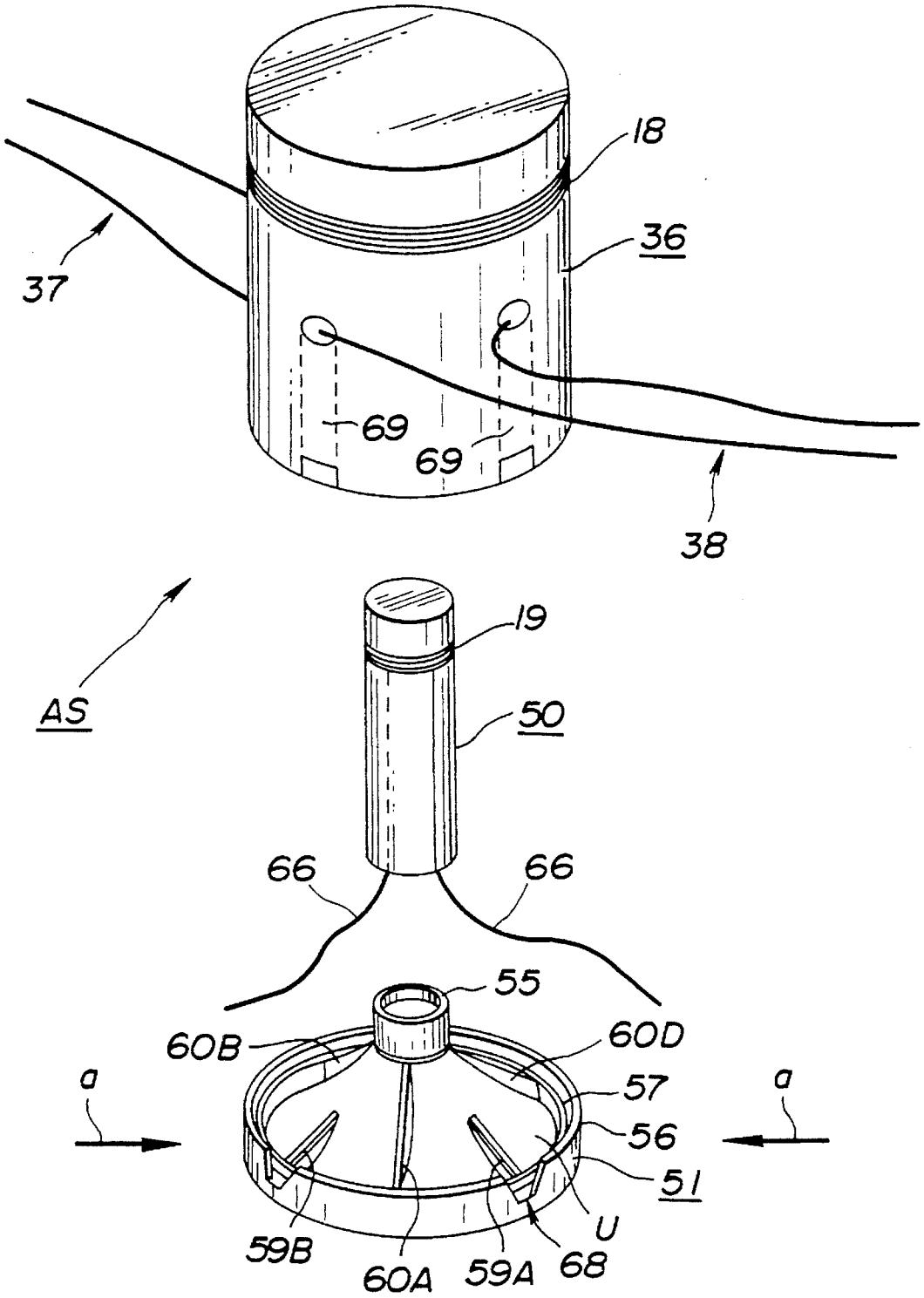
FIG. 5 is an exploded perspective view for illustrating an assembling operation for a coil assembly of the MFB speaker unit.
Figure 6:
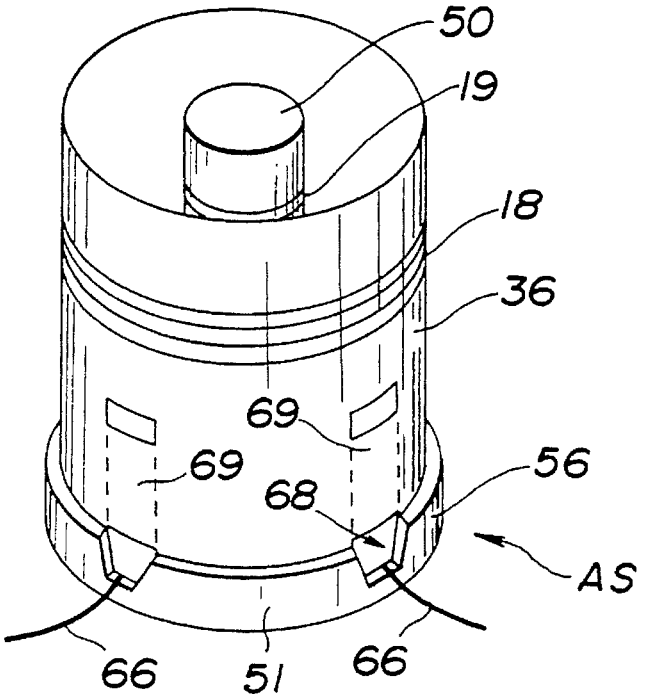
FIG. 6 is a perspective view showing the construction of the coil assembly.

Referring to FIGS. 5 and 6, the voice coil 36 and the detection coil 19 are wrapped around the coil bobbin 36 and a detection coil bobbin 50, respectively, after which the coil bobbins 36 and 50 are connected to a coupler 51 for completing the coil assembly AS. As a result, the voice coil 18 and the detection coil 19 are arranged coaxially.

Figure 7:
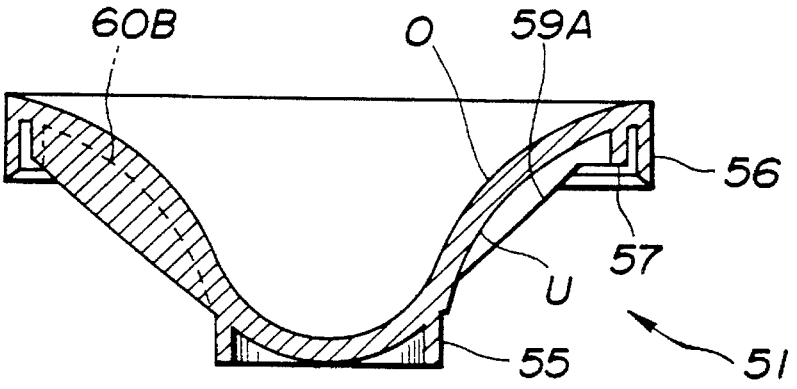
FIG. 7 is a cross-sectional view showing the construction of a coupler.
Figure 8:
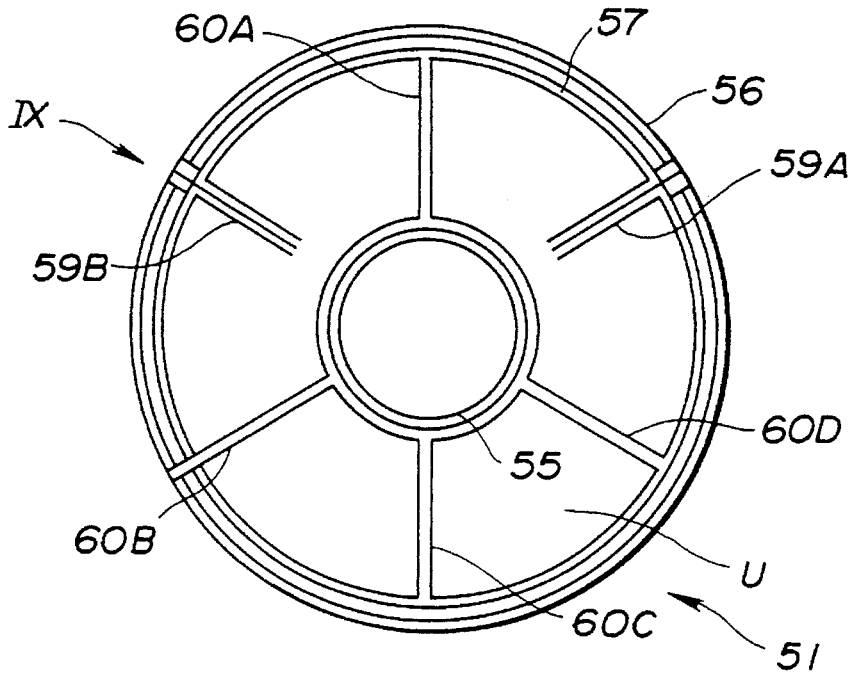
FIG. 8 is a front view showing a coupler surface.

Referring to FIGS. 7 and 8, the coupler 51 is molded of synthetic material substantially as a cone and has a cylindrically upstanding rib 55 on its rear surface.

The rib 55 has its outer diameter machined with high accuracy relative to the inner diameter of the coil bobbin in order to permit the coil bobbin 50 to be positioned with high accuracy relative to the rib 55 when the coil bobbin is fitted thereto.

It is possible with the coupler 51 to hold the detection coil 19 in position by a simple assembling operation of forming a holder for the coil bobbin 50 by the rib 55 and fitting the coil bobbin 50 to the bobbin holder to which an adhesive is previously applied.

The coupler 51 is formed with two outer peripheral ribs 56, 57 concentrically relative to the rib 55, and the outer rib 56 is fitted to the coil bobbin 36 of the coil bobbin 18.

Thus it is possible with the coupler 51 to hold the voice coil 18 in position by forming a bobbin holder for the voice coil bobbin 36 by the rib 56 and by fitting the voice coil bobbin 36 on the rib 56 after applying the adhesive thereto. In this manner, the voice coil 18 and the detection coil 19 may be held coaxially with high precision.

The coil bobbin 50 for the inwardly positioned detection coil 19 may be held by a simplified holding mechanism by fitting the inner periphery of the coil bobbin 50 with the outer periphery of the rib 55 of the coupler 51. The outwardly positioned voice coil bobbin 36 is held by being fitted to the rib 56. A rib 57 is also formed outside of the rib 56 for defining a groove therebetween in order to prevent the adhesive bonding the voice coil bobbin 36 and the coupler 51 from being exposed to outside of the coupler 51.

After the adhesive is applied to the coupler 51 as indicated by an arrow a, the coil assembly AS may be assembled with the lateral side of the outer rib 56 for simplifying the overall assembly operation.

The ribs 55 to 57 making up the bobbin holder of the coupler 51 may be molded integrally of synthetic resin to a reduced wall thickness for maintaining concentric configuration of the ribs 55 to 57 in order to prevent the weight mass of the vibrating system in its entirety from being increased effectively.

When maintaining the concentric configuration of the ribs 55 to 57 to a high accuracy, if the ribs 55 to 57 are connected linearly so that the cross-sectional shape of the coupler 5 is linear, the weight mass of the coupler 51 may be decreased most efficiently.

However, our experiments have indicated that, if the cross-sectional shape of the coupler 51 is linear, frequency characteristics are disturbed and the sound quality is lowered correspondingly. The present inventors have conducted repeated experimentation and found that frequency characteristics may be improved by forming a front surface O so as to be changed smoothly.

Based on this presupposition, we have conducted investigations into the sound quality using couplers of various cross-sectional configurations. Thus we have found that the reproduced sound may be improved in sound quality most outstandingly by forming the coupler surface so that the shape of the surface O is changed after the shape of the cone of the diaphragm 4.

That is, the coupler 51 has the shape of the surface O on the center cap side is smoothly curved and spread out from the center towards the outer side.

Thus it has been found that, with the loudspeaker apparatus 1, the sound quality may be improved by having the shape of the center cap side surface O of the coupler 51 smoothly curved and spread out from the center towards the outer side.

However, if the coupler 51 is of a reduced wall thickness, the coupler 51 undergoes torsional vibrations, as a result of which the detection coil 19 is vibrated in a wobbling manner against linear vibrations of the voice coil 18.

Consequently, with the present first embodiment, ribs 59A, 59B and 60A to 60D are formed radially between the ribs 55 and 57 on the reverse surface U of the coupler 51 for reinforcing the reduced wall thickness portion of the coupler 51.

In this manner, the coupler 51 may be formed sturdily in such a manner as to avoid increase in the overall weight mass, whereby the vibrations of the voice coil 18 may be correctly transmitted to the detection coil 19.

Consequently, it becomes possible with the loudspeaker apparatus 1 to obtain correct detection results of the vibrations via the detection coil 19 and hence to reproduce audio signals with high sound quality by feeding back the detection results.

Meanwhile, if the ribs 59A, 59B and 60A to 60D of synthetic material are formed in the portions of reduced wall thicknesses of the coupler, so-called sink marks are produced on the surface O.

The sink marks are changed multifariously depending on the molding conditions of the coupler 51. With the speaker unit 3, since the center cap 42 is formed by a transparent member, the sink marks of the coupler 51 may become visible from outside.

Figure 9:
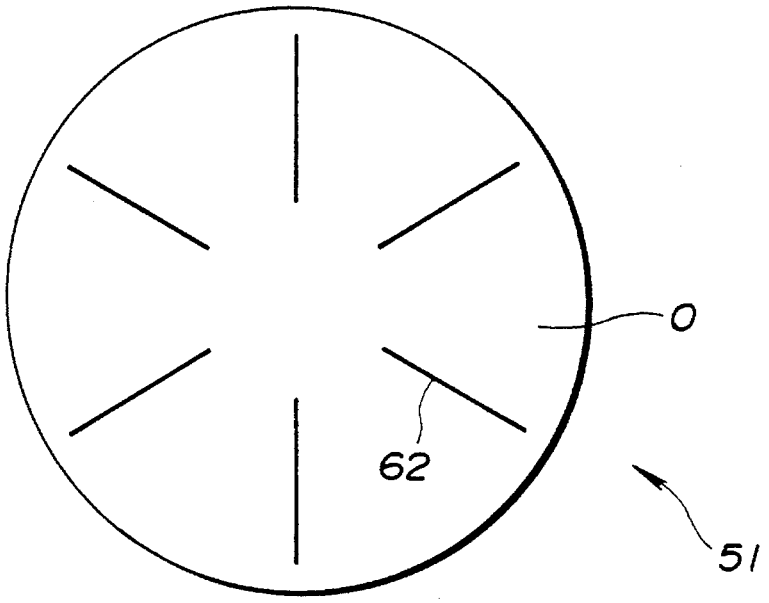
FIG. 9 is a back side view showing the back side of the coupler.

Consequently, with the first embodiment, a number of grooves 62 each having a depth 62 of not more than 1 mm are formed radially on the front surface O of the coupler 51 in association with the ribs 59A, 59B and 60A to 60D, as shown in FIG. 9.

If the grooves 62 are formed on the front surface O of the coupler in association with the ribs 59A, 59B and 60A to 60D on its reverse surface U, it becomes possible to avoid formation of the sink marks which amy be viewed from the surface O. In this manner, the speaker unit 3 may be prevented from being deteriorated in appearance effectively.

Figure 10:
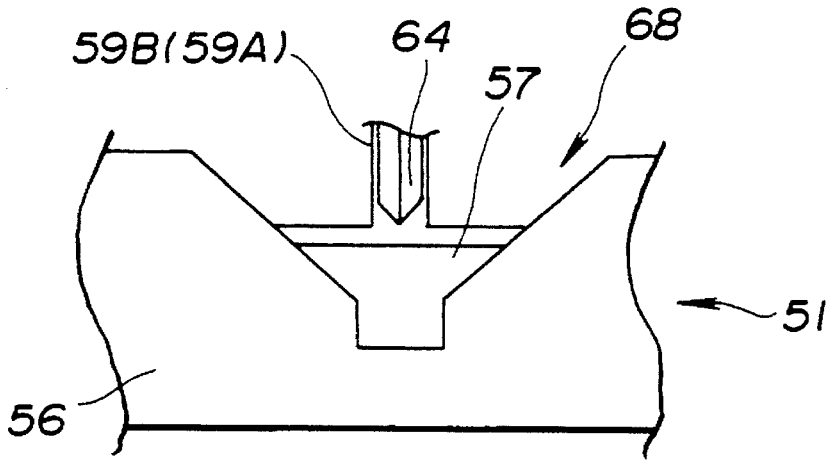
FIG. 10 is a side view sowing a rib of the coupler.

In the present first embodiment, the ribs 59A and 59B, among the ribs 59A, 59B and 60A to 60D, on the side of the terminal plate 40 connected to the detection coil 19, are formed to a reduced height, while the end faces of the ribs 59A, 59B are formed with grooves 64 extending lengthwise of the ribs 59A and 59B, as shown in FIG. 10.

With the present coupler 5, when the coil assembly AS is formed as shown in FIG. 5, the detection coil 19 is pulled out along the grooves 64. Besides, a lead-out wire 66 of the detection coil 19 may be positioned by effectively utilizing the reinforcement ribs 59A and 59B.

Thus, with the speaker unit 3, the assembling operation of the coil assembly AS may be simplified while effectively avoiding increase in the mass weight of the vibrating system by effective utilization of the ribs 59A, 59B. Besides, since assembling may be made with the ribs 59A, 59B as reference during bonding of the coils bobbin 50 to the coupler 51, assembling errors may be avoided effectively.

In addition, a vee-shaped recess 68 is formed in the rib 56 of the coupler 51 on a line of extension of the ribs 59A, 59B and a rectangular cut-out is formed at the root of the vee-shaped recess 68.

Thus the wire 66 pulled out along the groove 64 as shown in FIG. 6 may be pulled out of the coil bobbin 36 via the vee-shaped recess 68.

With the coil assembly AS, when the voice coil bobbin 36 is bonded to the coupler 51 by applying an adhesive to the groove defined between the rib 56 and the inner rib 57, no mounting error is produced with the voice coil bobbin 36 due to provision of the wire 66. Thus, with the speaker unit 3, the voice coil 18 and the detection coil 19 may be maintained coaxially with correspondingly high accuracy.

The wire 66 thus pulled out of the voice coil bobbin 36 is connected to a relay member 69 of a copper foil bonded to the lateral side of the voice coil bobbin 36 and a braided metal wire 38 is connected via the relay member 69 to the terminal plate 40, thereby enabling outputting of the results of detection by the detection coil 19.

By pulling out the wire 66 out of the voice coil bobbin 36 and connecting the wine 66 to the terminal plate 40 via the relay member 69, the coil assembly AS and hence the speaker unit 3 may be assembled by a simplified assembling operation.

With the above-described arrangement, in which the coupler 51 coaxially holding the detection coil 19 and the voice coil 18 has the smoothly curved surface of being widened from the center towards the outer side, it becomes possible to avoid disturbances of frequency characteristics effectively and hence to reproduce audio signals of high sound quality.

By forming reinforcement ribs on the coupler 51, it becomes possible to detect vibrations of the voice coil 18 correctly and to reproduce audio signals with correspondingly high sound quality while increasing toughness of the coupler and effectively avoiding increase of the mass weight of the vibrating system. In addition, by pulling the wire via the ribs and forming the groove on the coupler surface between these ribs, it becomes possible to simplify the assembling operation, while effectively avoiding deterioration in appearance.

The loudspeaker apparatus according to a second embodiment of the present invention is now explained. The parts or components similar to those of the first embodiment are correspondingly numbered and are not explained herein for simplicity.

The loudspeaker apparatus according to the second embodiment is basically constructed in the same manner as in the first embodiment except that a coil bobbin 70 about which the detection coil bobbin 19 is wound and a coupler 71 are formed of a liquid crystal polymer. The coupler 71 is of the same shape as the coupler 51 shown in FIG. 7.

The liquid crystal polymer of the coil bobbin 70 and the coupler 71 may be a liquid crystal polymer of, for example, thermoplastic aromatic polyester based liquid crystal polymer. The thermoplastic aromatic polyester based liquid crystal polymer has parahydroxy benzoic acid, biphenol, terephthalic acid, 6-hydroxy- 2-naphthalene carboxylic acid or polyethylene terephthalate or the like, as its basic skeleton. Representative of the basic structures are those shown by the chemical formulas 1 to 3.

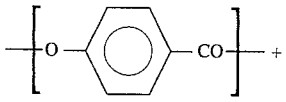

[chemical formula 1]

-continued

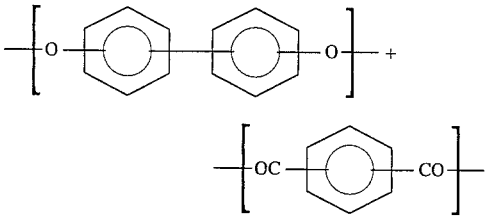

[chemical formula 2]

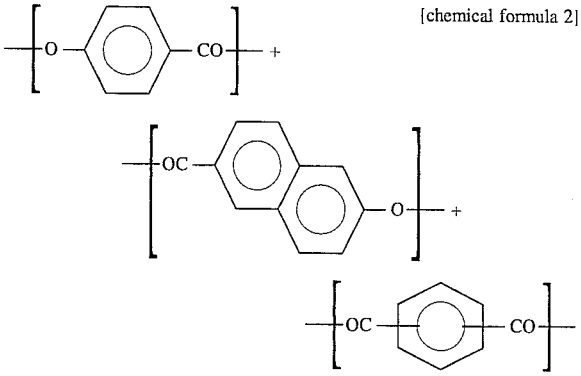

[chemical formula 3]

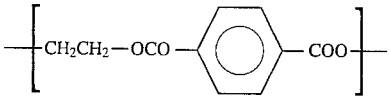

In addition, any of the commercially available thermoplastic aromatic polyester based liquid crystal polymers, such as copolymers of polyethylene terephthalate-p-hydroxy benzoic acid and polyethylene terephthalate, or co-polyesters produced on melt polymerization of p-acetoxy benzoic acid, terephthalic acid or naphthalene diacetate, may also be employed.

The above-enumerated liquid crystal polymers are strongly anisotropic and difficult to mold by injection molding. Thus it is also possible to mix a filler, such as glass fibers, in order to moderate anisotropy to a certain extent. The filler may be enumerated by carbon fibers, talc, mica or graphite, in addition to the glass fibers.

In the present second embodiment, the liquid crystal polymer manufactured by POLYPLASTICS INC. under the trade name of Vectler 950 was employed as the liquid crystal polymer.

Figure 11:
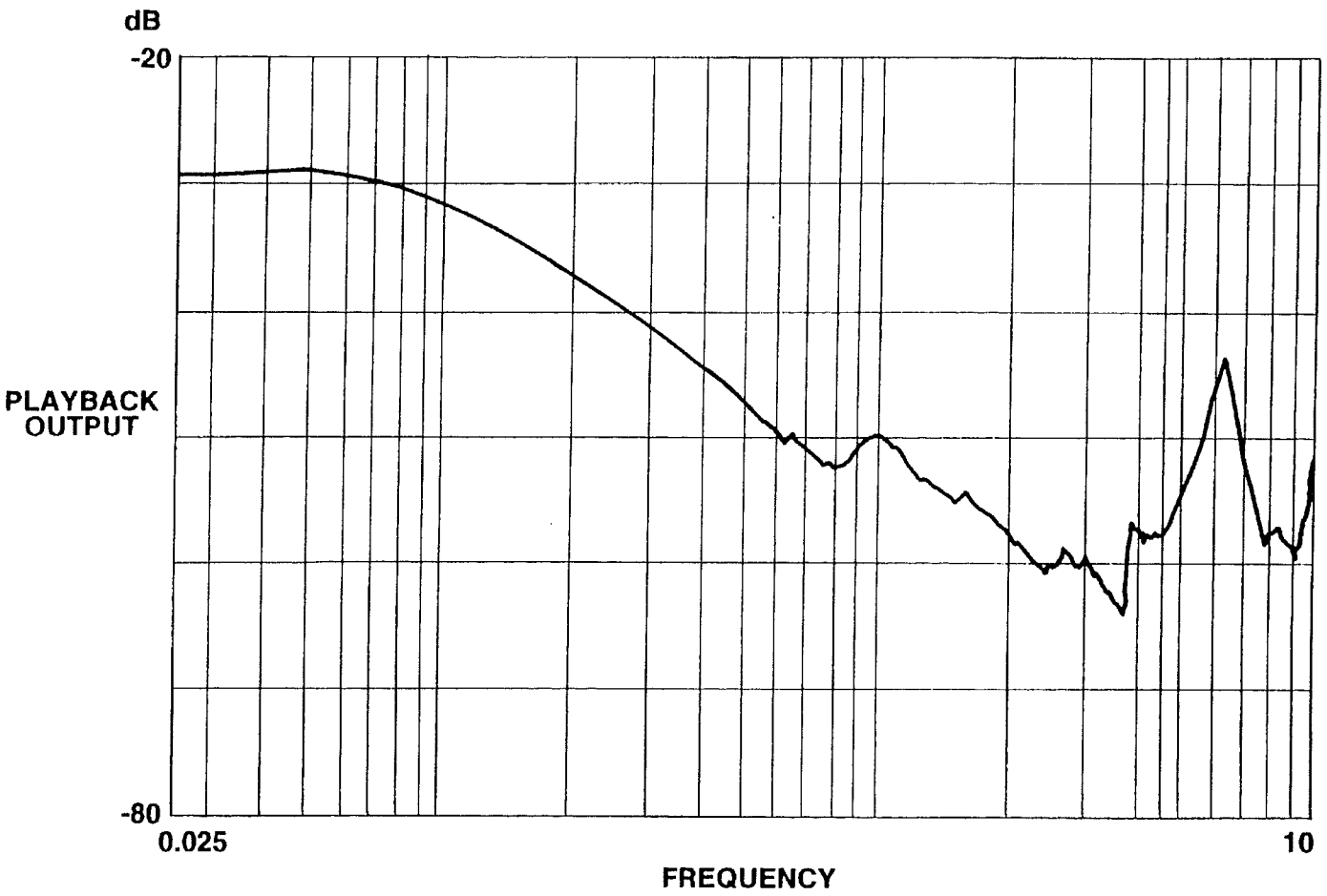
FIG. 11 is a graph showing a curve showing loop gain-frequency characteristics of a loudspeaker according to a second embodiment.

FIG. 11 shows the loop gain-frequency characteristics of the MFB loop of the loudspeaker apparatus of the present second embodiment. In the second embodiment, the point of resonance of the coupler 71 appears at 6225 Hz. However, decrease in level of 15 dB is noticed as compared to the loop gain at $f_0$ in the vicinity of 50 Hz, thus providing sufficient gain allowance. Consequently, no oscillation is produced even if reproduction is performed in the vicinity of the resonant frequency, so that the resulting speaker unit is satisfactory insofar as the sound quality is concerned.

COMPARATIVE EXAMPLE 1

Figure 12:
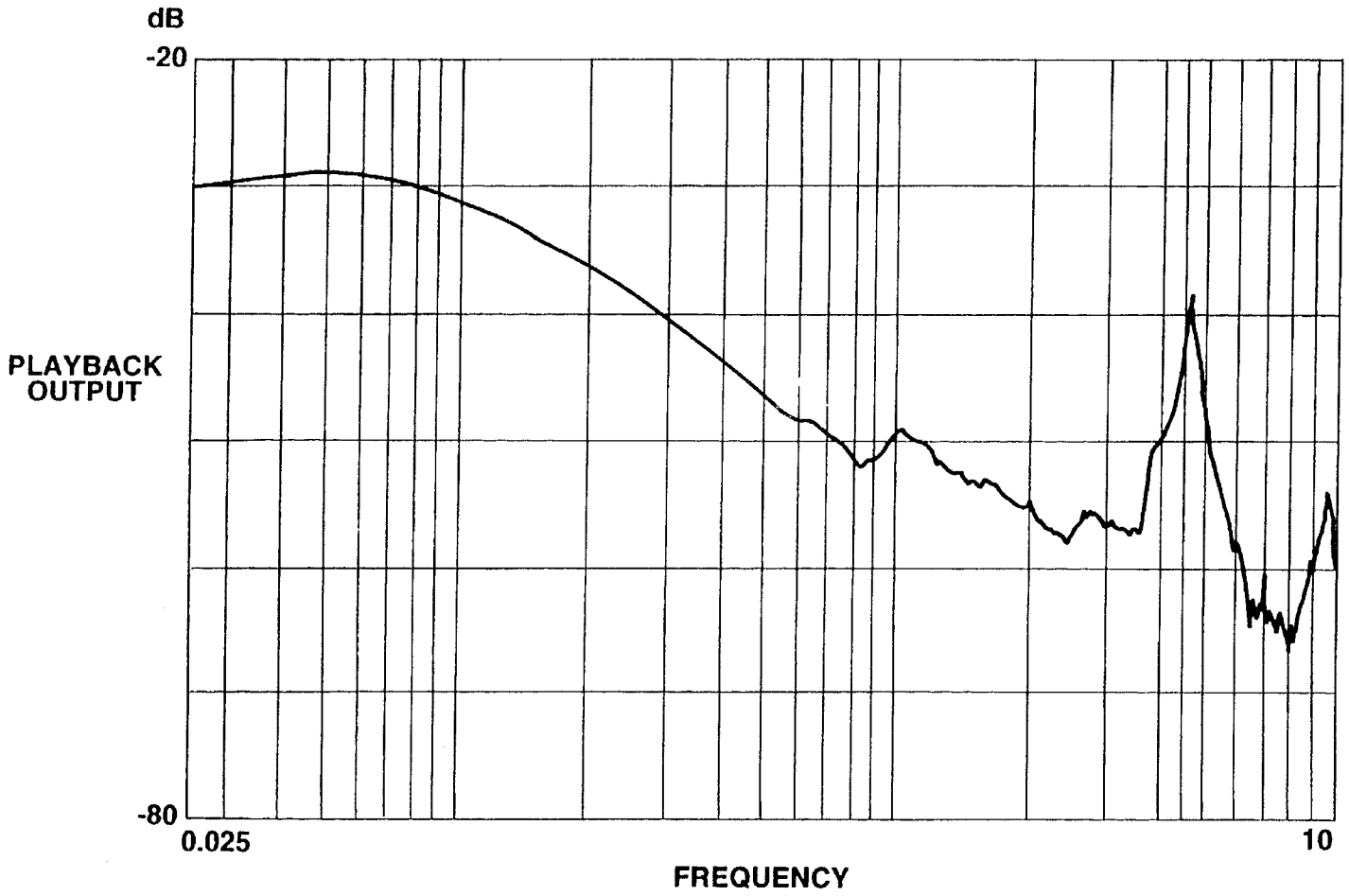
FIG. 12 is a graph showing a curve showing loop gain-frequency characteristics of a Comparative Example 1.

FIG. 12 shows similar characteristics when use is made of an ABS resin GR-1000 manufactured by DENKI KAGAKU KOGYO KK as the coupler material. The coupler has the resonant peak at 4575 Hz, with the level being +1.7 dB. If the playback sound is heard, since a peak exists at a level in excess of a pre-set value, oscillation is produced in the vicinity of the resonant frequency, such that the coupler as such cannot be used for the speaker unit.

COMPARATIVE EXAMPLE 2

Figure 13:
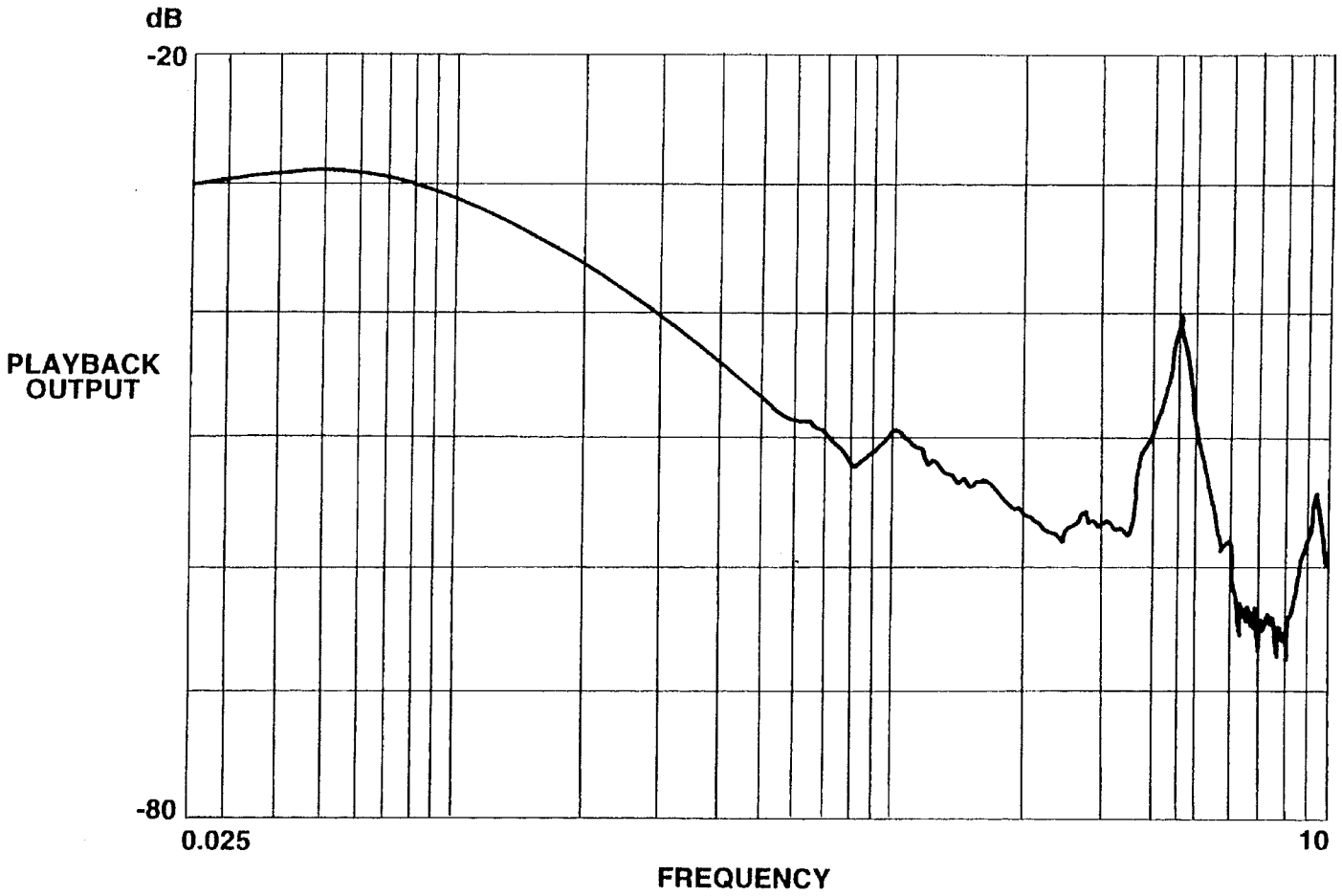
FIG. 13 is a graph showing a curve showing loop gain-frequency characteristics of a Comparative Example 2.

Butyl rubber was bonded to the back side of a coupler of ABS resin and measurements were made under damped state of the coupler. The results are shown in FIG. 13.

The peak of resonance was observed at substantially the same frequency as that of the Comparative Example 2. The level of the resonant peak was −0.2 dB which was similar to the pre-set value, such that stable states free of oscillation cannot be produced and the sound quality was also unsatisfactory.

Figure 14:
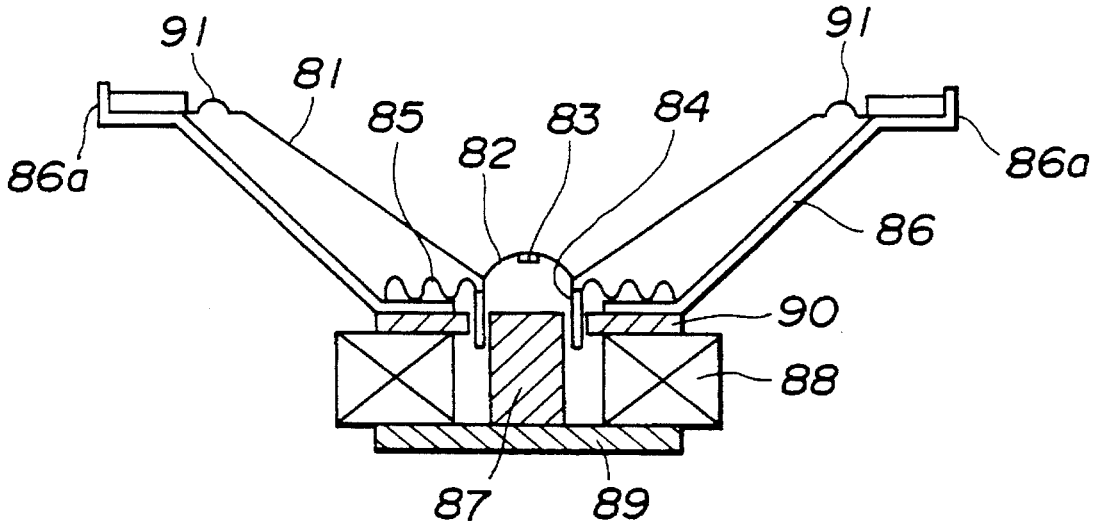
FIG. 14 is a cross-sectional view showing the construction of a loudspeaker according to a third embodiment.

Referring to FIG. 14, the loudspeaker apparatus according to a third embodiment of the present invention is explained. The present third embodiment is directed to a loudspeaker apparatus of the type in which a center cap of a dynamic speaker is provided with a sensor generating the voltage proportional to the amplitude of the vibrating system.

The loudspeaker apparatus shown in FIG. 14 includes a center cap 82 provided at the center of a cone-shaped diaphragm 81 and a piezoelectric sensor 83 is provided as a sensor on the reverse surface of the center cap 82.

A voice coil 84 is mounted downwardly of a connecting portion between the diaphragm 81 and the center cap 82 of the diaphragm 81. The diaphragm 81 is supported for vertical movement by the frame 16 via a damper 85.

The diaphragm 81 has its upper end mounted with an edge 91 on an upper mounting portion 86*a* of a frame 86 with the use of an adhesive or the like. The center cap 82 is formed of a liquid crystal polymer.

A magnetic circuit made up of a center pole 17, a magnet 18, a yoke 19 and a top plate 20 is arranged around the voice coil 84. The voice coil 14 is inserted in a magnetic gap defined between the center pole 17 and the top plate 20.

A speaker unit was fabricated using a nylon film and a liquid crystal polymer film as the material for the center cap 82. Fog. 15 shows loop gain-frequency characteristics of the loudspeaker apparatus.

Figure 15:
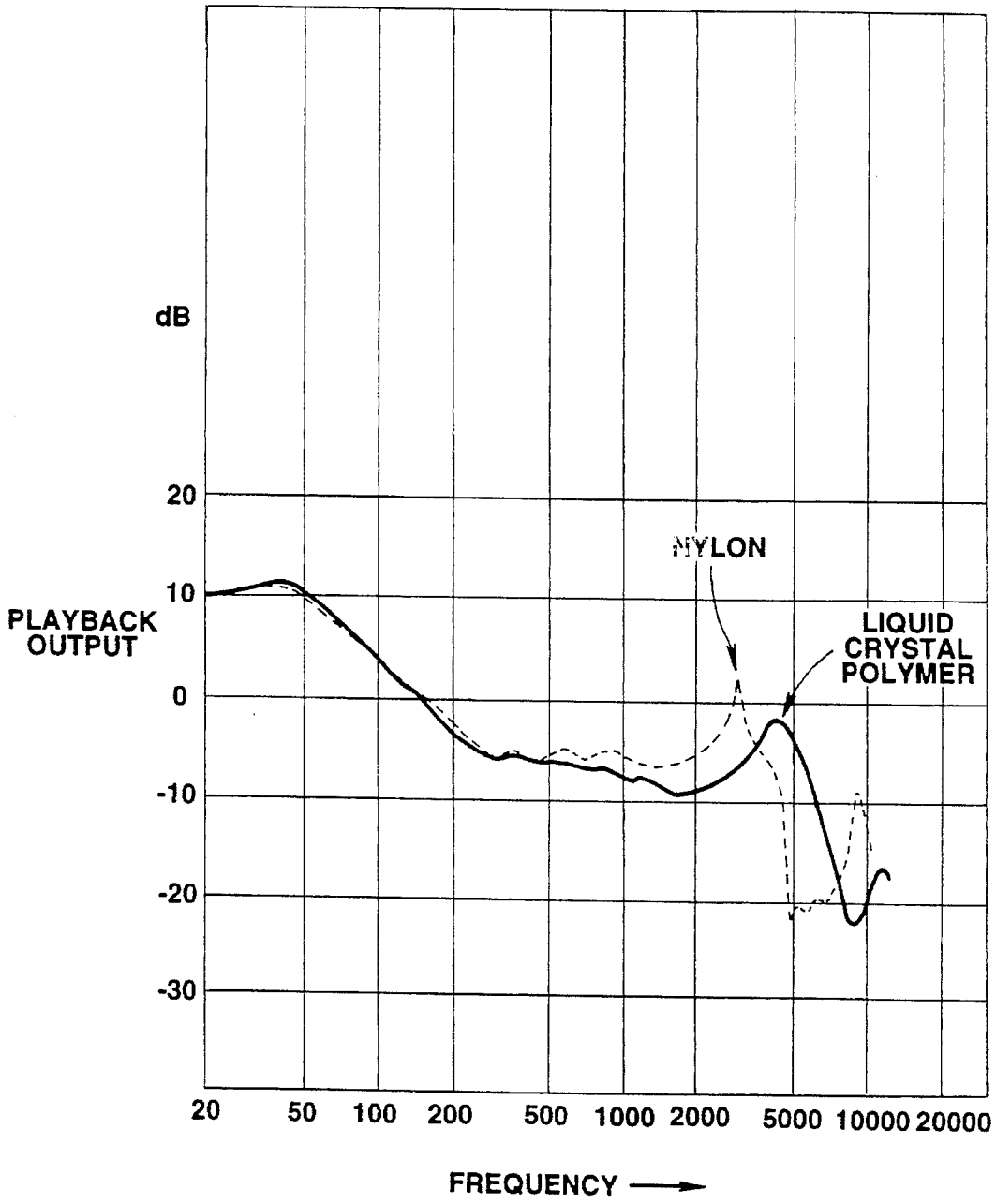
FIG. 15 is a graph showing loop gain-frequency characteristics with the use of a nylon film and a liquid crystal polymer as center caps.

It is seen from FIG. 15 that the resonant frequency of the center cap formed of the liquid crystal polymer of the present embodiment is shifted towards the higher frequency side as compared wit that of the center cap of nylon, while the peak level is suppressed, so that a sufficient gain may be produced.

Since the liquid crystal polymer is used as the coupler material in the second and third embodiments, the resonant frequency may be increased and the peak may be suppressed because of high toughness and vibration damping characteristics proper to such coupler material. Thus it becomes possible to lower the level of resonance in order to avoid the phenomenon of oscillation which is raised with the MFB speaker.

What is claimed is:

1. A loudspeaker apparatus comprising a diaphragm, driving means for driving said diaphragm, said driving means having a first bobbin, a voice coil wound about the first bobbin, and a driving magnetic circuit for generating the driving power driving said diaphragm along with said voice coil, detection means having its terminal voltage changed responsive to the rate of displacement of said diaphragm or said first bobbin, said detection means having a second bobbin arranged coaxially as said first bobbin, a detection coil wound about said second bobbin and a detection magnetic circuit for detecting displacement of said diaphragm or said first bobbin along with said detection coil, a coupling member interconnecting said first and second bobbins so that the first and second bobbins are coaxially aligned to each other, said coupling member interconnecting the first and second bobbins so that the end of the first bobbin is protruded beyond the end of the second bobbin along the direction of a coaxial line, the coupling member having its outer surface smoothly curved towards the center from outside of said coaxial line.

2. The loudspeaker apparatus as claimed in claim 1 wherein plural ribs are formed radially on the inner surface of said coupling member from a holding portion thereof for said second bobbin towards a holding portion thereof for said first bobbin.

3. The loudspeaker apparatus as claimed in claim 2 wherein plural grooves are formed on the outer surface of said coupling member in association with said ribs.

4. The loudspeaker apparatus as claimed in claim 2 wherein a groove is formed along one of the ribs at an end face of the one rib and wherein a lead of said detection coil is held by said groove.

5. The loudspeaker apparatus as claimed in claim 4 wherein plural grooves are formed on the outer surface of said coupling member in association with said ribs.

6. The loudspeaker apparatus as claimed in claim 4 wherein said coupling member is formed of a liquid crystal polymer.

7. A loudspeaker apparatus comprising a diaphragm, driving means for driving said diaphragm responsive to an input driving signal, said driving means having a first bobbin mounted on said diaphragm, a voice coil wound about said first bobbin and a driving magnetic circuit for producing a driving power driving the diaphragm along with the voice coil, detection means having its terminal voltage changed responsive to the rate of displacement of said diaphragm or said first bobbin, said detection means having a second bobbin about which a detection coil is wound and a detection magnetic field detecting displacement of said diaphragm or said first bobbin along with said detection coil, and a coupling member interconnecting said first and second bobbins, said coupling member being cup-shaped and having its front surface smoothly curved from the outer side towards the center, said coupling member having one of the first and second bobbins mounted on the outer periphery thereof and having the other of the first and second bobbins mounted at the mid portion thereof, wherein said driving means and the detection means are coaxially arranged and a detection signal of said detection means is fed back to said driving means.

8. The loudspeaker apparatus as claimed in claim 7 wherein plural ribs are formed radially on the inner surface of said coupling member from a holding portion thereof for said second bobbin towards a holding portion thereof for said first bobbin.

9. The loudspeaker apparatus as claimed in claim 8 wherein plural grooves are formed on the outer surface of said coupling member in association with said ribs.

10. The loudspeaker apparatus as claimed in claim 8 wherein a groove is formed along the rib at an end face of the rib and wherein a lead of said detection coil is held by said groove.

11. The loudspeaker apparatus as claimed in claim 10 wherein plural grooves are formed on the outer surface of said coupling member in association with said ribs.

12. The loudspeaker apparatus as claimed in claim 7 wherein said coupling member is formed of a liquid crystal polymer.

13. A loudspeaker apparatus comprising a diaphragm, driving means for driving said diaphragm responsive to an input driving signal, said driving means having a first bobbin mounted on said diaphragm and a voice coil wound about said first bobbin and generating a driving power driving said diaphragm along with said driving magnetic circuit responsive to an input driving signal, detection means for detecting displacement of said first bobbin or said diaphragm, and coupling means interconnecting said driving means and the detection means, wherein at least the coupling means is formed of a liquid crystal polymer.

14. The loudspeaker apparatus as claimed in claim 13 wherein said detection means has a further bobbin about which a detection coil for detecting displacement of said first bobbin or said diaphragm is wound, and a detection magnetic circuit for detecting displacement of said first bobbin or said diaphragm along with said detection coil, said coupling means being formed of a liquid crystal polymer and interconnecting said first bobbin and the further bobbin so that the first bobbin and the further bobbin are arranged coaxially.

15. The loudspeaker apparatus as claimed in claim 13 wherein said coupling means comprises a cap of a liquid crystal polymer mounted on said diaphragm.

* * * * *